US006375537B1

(12) United States Patent
Jankowski

(10) Patent No.: US 6,375,537 B1
(45) Date of Patent: Apr. 23, 2002

(54) PROTECTIVE BREAST SHIELD

(76) Inventor: Susan Charlotte Jankowski, 121 Palm La., Islamorada, FL (US) 33036

( * ) Notice: Subject to any disclaimer, the term of this patent is extended or adjusted under 35 U.S.C. 154(b) by 0 days.

(21) Appl. No.: 09/813,521

(22) Filed: Mar. 22, 2001

(51) Int. Cl.[7] ..... A41C 3/00
(52) U.S. Cl. ..... 450/39; 2/25; 450/57
(58) Field of Search ..... 2/4, 55, 44, 463, 2/45, 2, 5, 92, 459, 461; 450/39, 50–57, 30–32, 79, 80, 82

(56) References Cited

U.S. PATENT DOCUMENTS 2,468,841 A * 5/1949 Siegel ..... 2/455
3,162,861 A * 12/1964 Gustafson ..... 2/455
3,176,686 A * 4/1965 Barnes ..... 2/455
4,272,847 A * 6/1981 Buhler ..... 2/455
5,769,688 A * 6/1998 Holliday ..... 450/57
5,806,103 A * 9/1998 McCracken et al. ..... 2/455
6,161,226 A * 12/2000 Serewicz et al. ..... 2/459

* cited by examiner

*Primary Examiner*—Gloria M. Hale
(74) *Attorney, Agent, or Firm*—Lesley Ann Rhyne

(57) ABSTRACT

A protective breast shield 1 is provided having an inner and outer layer 4, 2 for protecting from blows to the breast area. The outer layer 2 is made of impact resistant material and the inner layer 4 is made of a soft padding type material. There are also straps 3 attached to the inner layer 4 for attaching the breast shield to a body.

6 Claims, 5 Drawing Sheets

PROTECTIVE BREAST SHIELD

FIELD OF THE INVENTION

This invention relates in general to a protective shield for the breast area and more particularly to a protective breast shield having an outer impact resistant layer and inner padding layer.

BACKGROUND TO THE INVENTION

In many sports and even in some industry, it is important to protect parts of the body. Helmets, shin guards, teeth guards and even guards for the male groin area are available for impact protection in a variety of sports. However, there are an increasing number of girls and women participating in sports and there is a lack of protective equipment designed for such females to wear.

In all sports, such as basketball, baseball, softball, and football there are a number of events that cause blows to the breast area of a player. Such blows can be from other players, equipment or the balls used during play of the sport. In soccer, blows from a hard soccer ball are often suffered to the breast and chest area. The ball may be kicked or even thrown by another player. Particularly, if kicked, the impact from the ball to a breast area can be substantial. In men's soccer, men are at an advantage because an effective maneuver is to hit a high ball with the chest area. Without a protective shield such a maneuver would be painful and may cause damage to a female.

The breast area of female includes very sensitive breast tissue. It is not desirable nor is healthy to have such sensitive tissue hit or damaged. In fact, there has been some research that has shown that damage to the breast area may result in a future cancer site. Therefore, it has become even more imperative to protect the breast area of women of all ages, including young girls.

There are a variety of sports bras available. However, such bras merely add more support for the breast area but fail to protect the breast area from impact. Specifically for the breast area, females need protective equipment that will save the breast tissue from impact.

Thus, there is a need to provide a protective shield for the breast area that is impact resistant.

DETAILED DESCRIPTION OF THE PREFERRED EMBODIMENT

Figure 1:
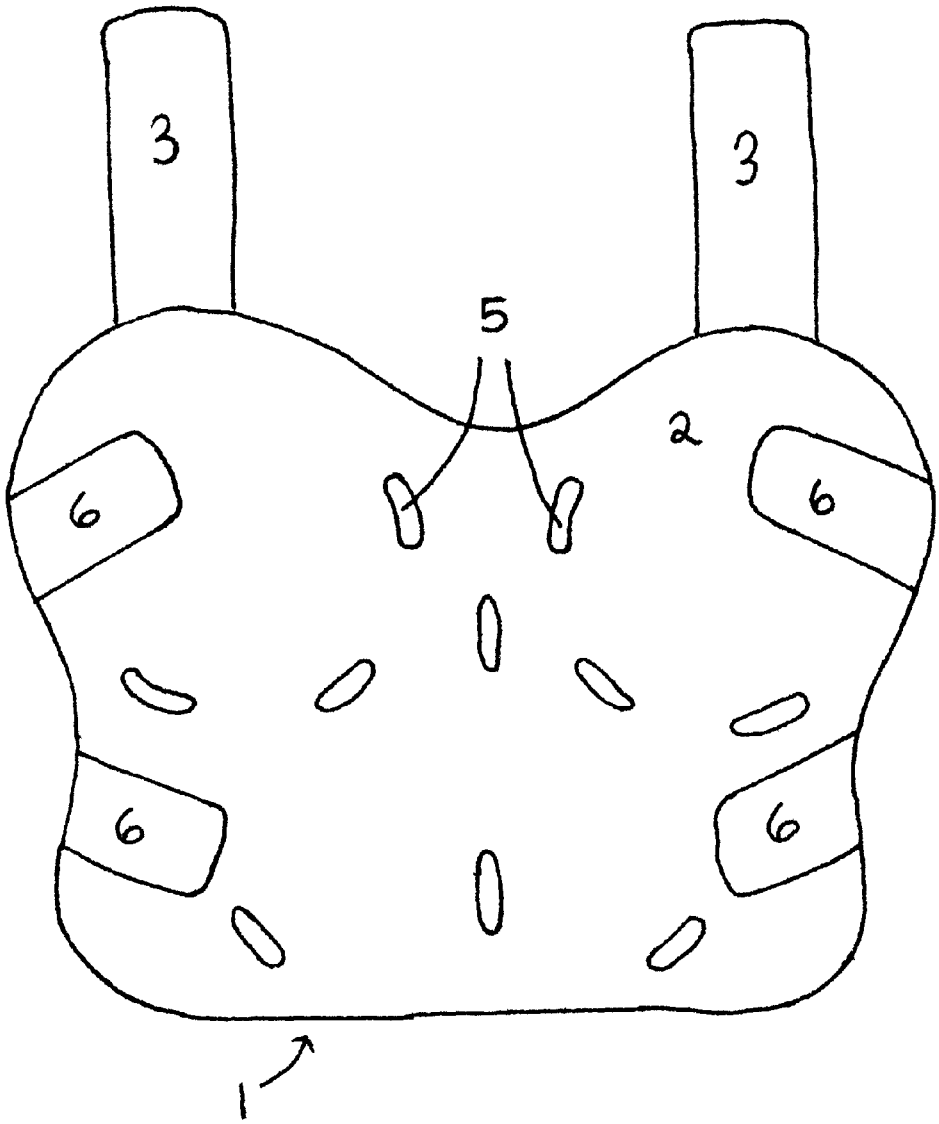
FIG. 1 shows a front view of a protective breast shield according to an embodiment of the present invention.

This invention is described with reference to the FIGS. FIG. 1 shows a protective breast shield 1. The protective breast shield 1 includes an outer layer 2, the outside of which is shown. The shield 1 designed to fit over a female breast area and over some, if not all, of a rib cage area. The outer layer 2 is made of an impact resistant material. It may be designed as a one piece hard smooth shell. It may be made of a molded polycarbonate material, specially designed to be anatomically correct. It may also be made of a clear resin material and include a design of any type on the outer layer 2. FIG. 1 shows two straps 3 at the top of the shield 2 that may be made of an elastic nylon material. The straps are for attaching the shield I to a body. There are velcro receiving tabs 6 shown on the outside of the shield for attaching an inner layer (shown in FIG. 2) to the outer layer 2. In an alternative embodiment, the straps 3 may be wrapped around a female's back and attached to the velcro receiving tabs 6, thus attaching the shield 1 comfortably to the body. At least two velcro receiving tabs may be used. Such receiving pads may be placed anyway on the shield as deemed comfortable and necessary for a proper fit. Ventilation holes 5 are shown in the outer layer to allow air to circulate. Any number of holes 5 may be allowed for ventilation. Such ventilation holes may also be designed to allow the outer layer to flex where so desired. FIG. 1 shows a pattern of such holes 5 around the breast area, down the middle of the chest and near the bottom of a rib cage area. Such design allows for flexibility of the hard outer layer 2 as well as for ventilation.

Figure 2:
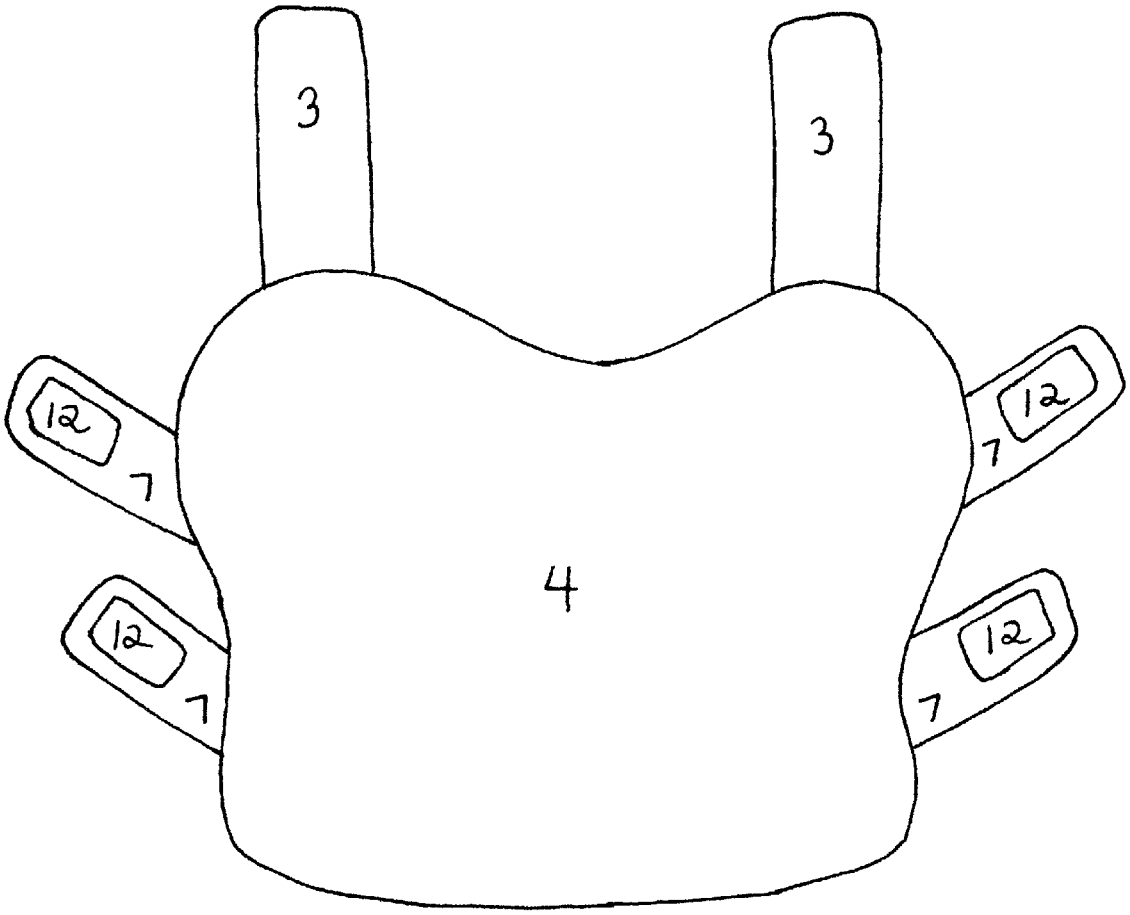
FIG. 2 shows a front view of an inner layer of a protective breast shield according to an embodiment of the present invention.

FIG. 2 shows a front view of the inner layer 4 when detached from an outer layer. The inner layer 4 may be made of any soft material suitable for padding purposes. Such suitable material may be padded nylon backing or foam padding. An example of such material is EVA foam, or perforated EVA foam. A further embodiment of the present invention includes the inner layer 4 having at least one hole. Such holes may serve any number of reasons, such as for ventilation and/or flexibility. A pattern of such holes may be desired for optimum ventilation and/or flexibility. The inner layer includes the straps 3 for going over a female's shoulders for attaching to a body. The inner layer also includes elastic tabs 7 having velcro fasteners 12 (or hook and loop fasteners) for attaching to the velcro receiving tabs 6 (shown in FIG. 1). In FIG. 2, the elastic tabs 7 and fasteners 12 attach the inner layer 4 to the outer layer 2 of the protective breast shield 1.

Figure 3:
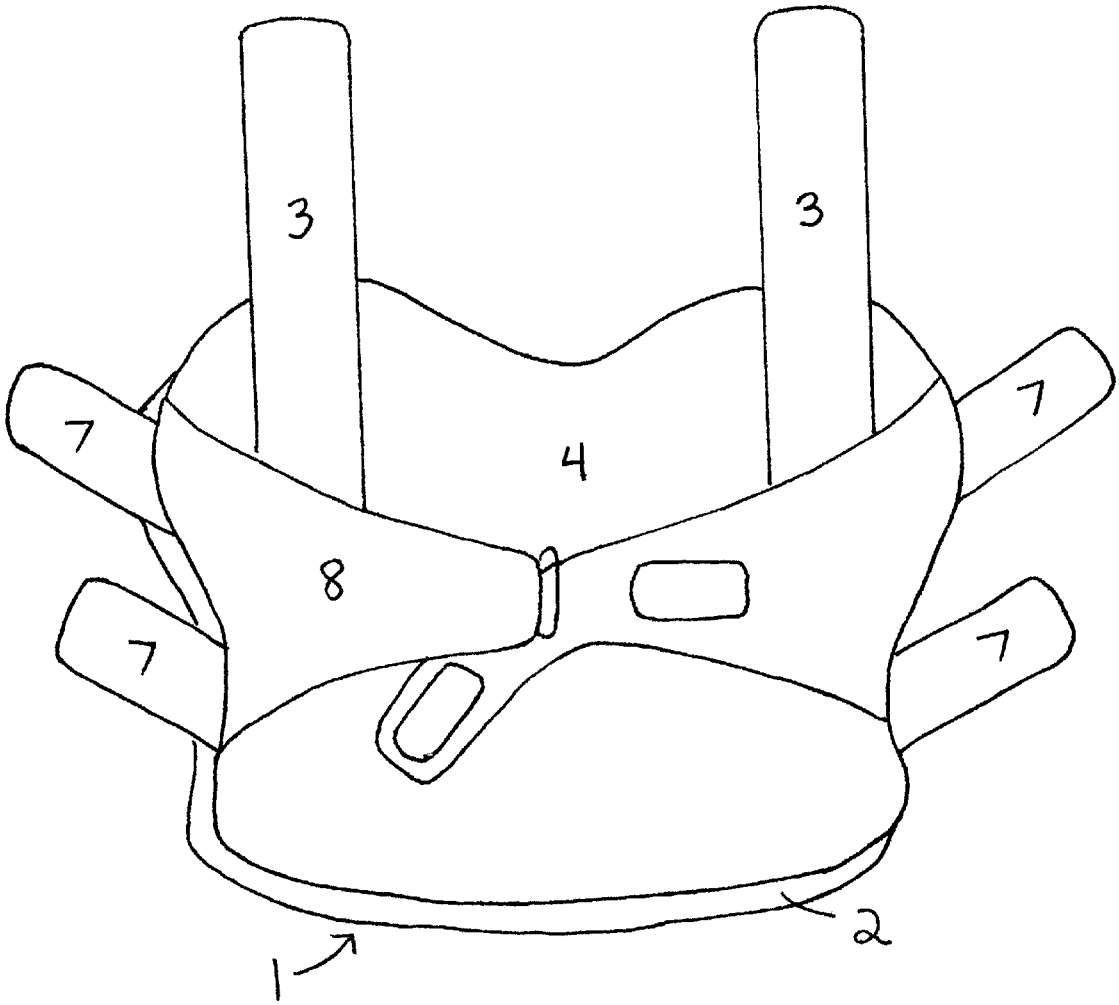
FIG. 3 shows a back view of a protective breast shield according to an embodiment of the present invention.

FIG. 3 shows an inner layer 4 attached to a back side or inside of the outer layer 2 of the protective shield 1. In an alternative embodiment, the straps 3 may be attached to the outer layer 2 or inner layer 4. However in the present embodiment, the straps 3 are attached to the inner layer 4 and are further attached to a bra type strap 8 that crosses the back of a body. The bra strap 8 further includes hook fasteners 10 or means for hooking the ends together around a body. Attached to the inner layer 4 are elastic tabs 7 that are for attaching inner shell 4 to the outer shell 2 via fasteners 12 and the velcro receiving tabs 6 (see FIG. 1). The inner shell 4 is shown to be detachable by use of the fasteners 12 for ease of cleaning and for replacement of either the inner layer 4 or outer layer 2 or as may become necessary. However, it is an embodiment of this invention that the inner layer 4 may be made to be more permanently attached to the outer layer 2.

SUMMARY OF THE INVENTION

According to the present invention a protective breast shield is provided comprising an outer layer and an inner layer. The outer layer is made of an impact resistant material The inner layer is attached to a back side of the outer layer and the inner layer is made of a soft material. There are also straps attached to the inner layer for attaching the breast shield to a body.

Figure 4:
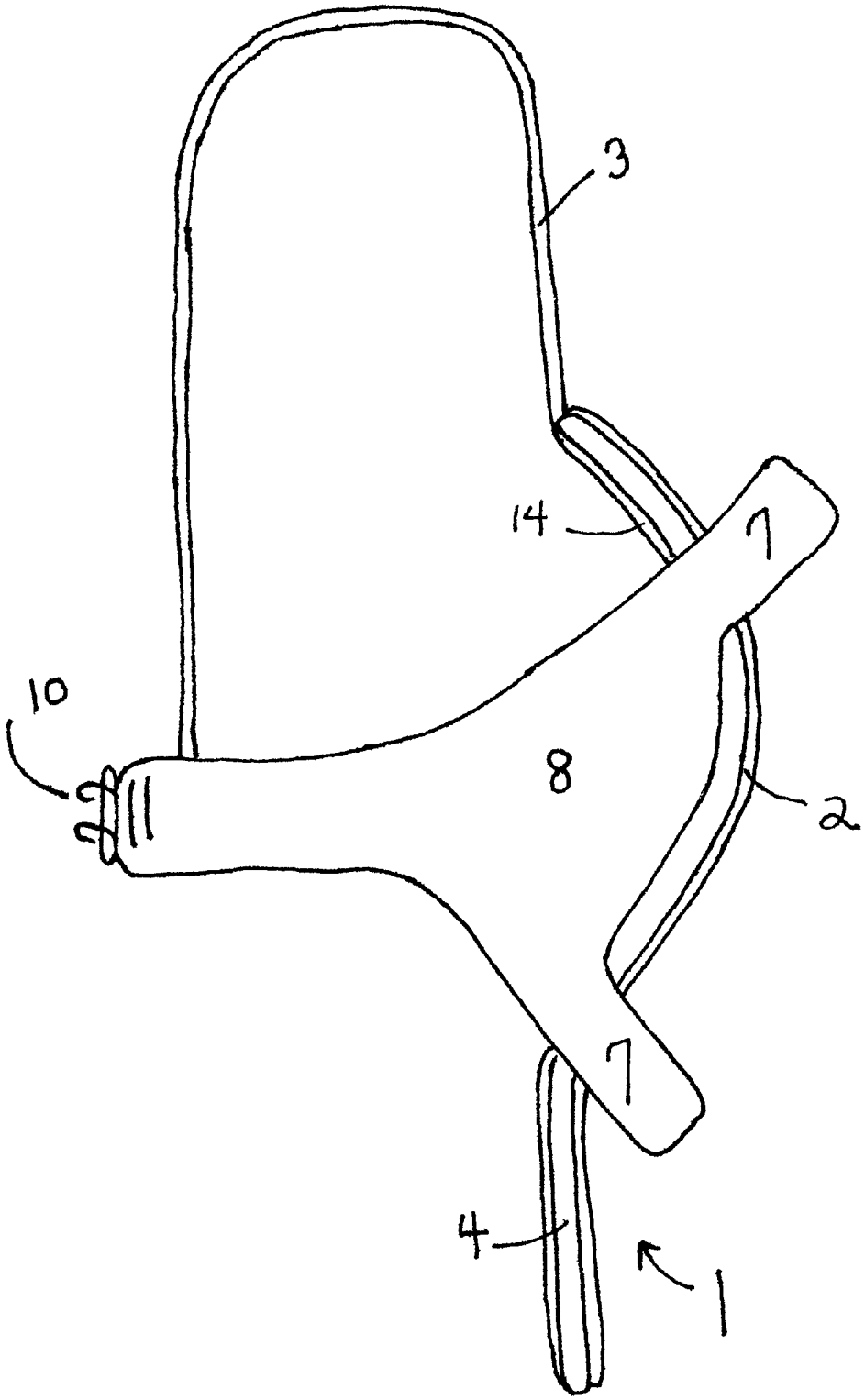
FIG. 4 shows a side view of a protective breast shield according to an embodiment of the present invention.

FIG. 4 shows a side view of the breast shield 1. The inner layer 4 comfortably fits in the inside of the outer layer 2. The inner layer 4 is attached to the outside layer 2 by elastic tabs 7 (or hook and loop fasteners). The velcro receiving tabs 6 are on the outer layer 2 as shown in FIG. 1. In FIG. 4, the bra strap 8 having hook fasteners 10 are a part of the inner layer 4, however it is conceivable that such bra straps 8 could be attached to the outer layer 2 in another embodiment of the present invention.

Figure 5:
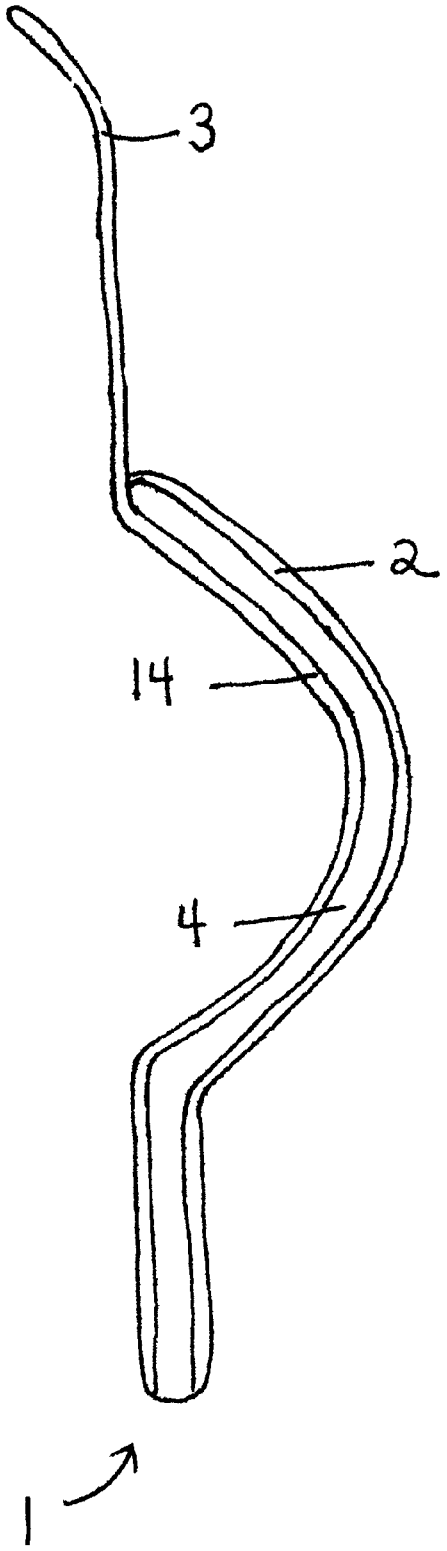
FIG. 5 shows a cross section side view of a protective breast shield according to an embodiment of the present invention.

FIG. 5 shows a cross section of a side view of the protective breast shield 1. The cross section shows the inner layer 4 lining a back side or an inside of the outer layer 2. The straps 3 are attached to the inner layer 4 and extend above the outer layer 2. A fabric lining 14 is shown and may be used to line the inner layer 4. The breast shield is shown to be anatomically correct to fit a female's body.

Thus the present invention provides a protective shield for receiving blows to the breast area. The outer layer 2 is impact resistant and the inner layer 4 is padding. Therefore, the outer layer 2 deflects a blow to the breast area while the inner layer absorbs the blow to the breast area The protective breast shield of the present invention is designed to allow females the ability to fully and freely engage in many sports or other activities without risking injury to their breast area.

What is claimed is:

1. A protective breast shield comprising:

an outer layer having a front side and a back side, the outer layer being made of an impact resistant material;

an inner layer attached to the back side of the outer layer, the inner layer being made of a soft material; and straps attached to the outer layer for attaching the breast shield to a body.

2. The protective breast shield of claim 1 wherein the outer layer is anatomically designed.

3. The protective breast shield of claim 1 wherein the outer layer is made of clear resin.

4. The protective breast shield of claim 1 wherein the inner layer is made of foam padding.

5. The protective breast shield of claim 1 further comprising at least one hole in the outer layer for ventilation purposes.

6. The protective breast shield of claim 1 further comprising a pattern of holes in the outer layer arranged for optimum flexibility and ventilation.

* * * * *